US010482839B2

(12) United States Patent
Pyun

(10) Patent No.: US 10,482,839 B2
(45) Date of Patent: Nov. 19, 2019

(54) LIQUID CRYSTAL DISPLAY APPARATUS WITH REDUCED HORIZONTAL CROSSTALK

(71) Applicant: LG Display Co., Ltd., Seoul (KR)

(72) Inventor: UnSeung Pyun, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 197 days.

(21) Appl. No.: 15/168,407

(22) Filed: May 31, 2016

(65) Prior Publication Data

US 2016/0351157 A1 Dec. 1, 2016

(30) Foreign Application Priority Data

May 31, 2015 (KR) ..... 10-2015-0076965

(51) Int. Cl.
*G09G 3/36* (2006.01)
*G09G 3/20* (2006.01)

(52) U.S. Cl.
CPC ..... *G09G 3/3688* (2013.01); *G09G 3/3696* (2013.01); *G09G 2310/027* (2013.01);
(Continued)

(58) Field of Classification Search
CPC ..... G09G 3/3696; G09G 3/3688; G09G 2310/0232; G09G 2340/0428;
(Continued)

(56) References Cited

U.S. PATENT DOCUMENTS

2007/0013799 A1* 1/2007 Hirota ..... H04N 5/217 348/311
2008/0088550 A1* 4/2008 Kim ..... H02M 3/155 345/82

(Continued)

FOREIGN PATENT DOCUMENTS

CN 101739966 A 0/6201
JP 2002-258812 A 9/2002
KR 10-2008-0105701 A 12/2008

OTHER PUBLICATIONS

First Notification of Office Action dated May 23, 2018, The State Intellectual Property Office of the Peoples Republic of China in counterpart Chinese application No. 201610374925.1.

(Continued)

*Primary Examiner* — Kwang-Su Yang
(74) *Attorney, Agent, or Firm* — Morgan, Lewis & Bockius LLP

(57) ABSTRACT

A liquid crystal display apparatus includes a plurality of sub-pixels configured to be operated by a gate signal transmitted from a gate driver and passing through a gate line and an image signal transmitted from a data driver and passing through a data line, a gamma voltage generator configured to supply gamma reference voltages for expressing gray levels to the data driver, a power supply unit configured to supply a first VDD signal to the gamma voltage generator and a second VDD signal to the data driver and a crosstalk compensation unit positioned between the power supply unit and the gamma voltage generator and configured to filter a ripple of the first VDD signal such that voltage of the first VDD signal is stabilized thereby reducing a level of crosstalk between the sub-pixels adjacent to one another.

22 Claims, 8 Drawing Sheets

(52) U.S. Cl.
CPC ..... *G09G 2310/0232* (2013.01); *G09G 2320/0209* (2013.01); *G09G 2320/0673* (2013.01); *G09G 2340/0428* (2013.01)

(58) Field of Classification Search
CPC ..... G09G 2310/027; G09G 2320/0209; G09G 2320/0673
See application file for complete search history.

(56) References Cited

U.S. PATENT DOCUMENTS

| | | | | |
|---|---|---|---|---|
| 2009/0073090 | A1* | 3/2009 | Hirakawa | G09G 3/3607 345/58 |
| 2009/0128536 | A1* | 5/2009 | Seo | G09G 3/3655 345/211 |
| 2009/0244109 | A1* | 10/2009 | Chen | G09G 3/3648 345/690 |
| 2010/0013869 | A1* | 1/2010 | Matsumoto | G09G 3/2011 345/690 |
| 2010/0060558 | A1* | 3/2010 | Kim | G09G 3/3655 345/87 |
| 2010/0097365 | A1* | 4/2010 | Fang | G09G 3/3648 345/212 |
| 2014/0192096 | A1* | 7/2014 | Maruyama | G09G 3/3666 345/690 |
| 2015/0194085 | A1* | 7/2015 | Nam | G09G 3/3208 345/691 |

OTHER PUBLICATIONS

Second Notification of Chinese Office Action issued in Chinese Patent Application No. 201610374925.1 dated Jan. 14, 2019.

* cited by examiner

LIQUID CRYSTAL DISPLAY APPARATUS WITH REDUCED HORIZONTAL CROSSTALK

CROSS REFERENCE TO RELATED APPLICATIONS

This application claims the benefit of the Korean Patent Application No. 10-2015-0076965 filed on May 31, 2015, which is hereby incorporated by reference as if fully set forth herein.

BACKGROUND

Technical Field

The present disclosure relates to a liquid crystal display apparatus, and more particularly, to a liquid crystal display apparatus capable of compensating crosstalk problem.

Description of the Related Art

As the information age has heightened, display apparatuses for visualizing digital image signals have been rapidly developed. In this regard, research has been continuously conducted on various display apparatuses to develop thin, light weight and low power consumption display apparatuses. Typical examples of such display apparatuses include a plasma display panel (PDP), a field emission display (FED), an electro-wetting display (EWD), an organic light emitting display device (OLED) and a liquid crystal display (LCD), etc.

A liquid crystal display apparatus can be made in a light weight and thin form. In addition, the liquid crystal display apparatus is advantageous in terms of power consumption, color gamut, resolution, and viewing angle. For these reasons, the liquid crystal display apparatus has been applied to various electronic devices.

However, the liquid crystal display apparatus may suffer from crosstalk caused by specific image patterns. In particular, the crosstalk of the liquid crystal display apparatus tends to become worse if the resolution of the liquid crystal display apparatus is increased. Therefore the crosstalk level of a high resolution liquid crystal display apparatus is increased and this phenomenon is regarded as a problem.

A method for compensating specific types of crosstalk has been attempted to solve the problem as described above such that specific crosstalk patterns of the liquid crystal display apparatus is recognized and an algorithm stored in the memory is selectively applied according to the recognized cross patterns.

A method for reducing the resistance of a common electrode has been attempted to solve the problem as described above such that distortion of a common voltage (Vcom) of the liquid crystal display apparatus is compensated.

A method for applying a common voltage (Vcom) compensation circuit to the common voltage (Vcom) supply circuit for sufficiently discharging the charged capacitance at the liquid crystal layer of the liquid crystal display apparatus has been attempted to solve the problem as described above. Particularly, this method was used for the line-inversion technology.

Various compensation methods, such as dot-inversion technology, have been attempted for stabilizing the common voltage (Vcom).

Horizontal crosstalk has been regarded as a chronic problem of the liquid crystal display apparatus, and such problem has not been effectively solved.

The inventor of the present disclosure has been conducted research and development for solving such horizontal crosstalk problems in liquid crystal displays.

In particular, the inventor of the present disclosure has recognized that horizontal crosstalk is because of unstable or deviated common voltage characteristics. More particularly, the inventor of the present disclosure has recognized that the root cause of the horizontal crosstalk is related to the extreme change in terms of required current flow of the liquid crystal display apparatus. Due to such extreme changes, the circuit driver of the liquid crystal display apparatus experiences current supply problems.

Furthermore, the inventor of the present disclosure has recognized that ripples occurring in the VDD signal for a specific image pattern can cause horizontal crosstalk being displayed and such VDD signal is supplied from the power supply unit to the gamma voltage generator which generates gamma voltage.

SUMMARY

Accordingly, the present invention is directed to a liquid crystal display apparatus that substantially obviates one or more of the problems due to limitations and disadvantages of the related art.

An object of the present disclosure is to provide a novel liquid crystal display apparatus comprising a horizontal crosstalk compensation unit which is capable of stabilizing the VDD signal by suppressing ripples of the VDD signal supplied from the gamma voltage generator. To do that, the liquid crystal display apparatus is configured with a dedicated VDD line (i.e., an individual VDD line or an exclusive VDD line) for the gamma voltage generator(s) and the data driver(s), respectively.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display apparatus comprises a plurality of sub-pixels configured to be operated by a gate signal transmitted from a gate driver and passing through a gate line and an image signal transmitted from a data driver and passing through a data line; a gamma voltage generator configured to supply gamma reference voltages for expressing gray levels to the data driver; a power supply unit configured to supply a first VDD signal to the gamma voltage generator and a second VDD signal to the data driver; and a horizontal crosstalk compensation unit configured to filter a ripple of the first VDD signal such that voltage of the first VDD signal is stabilized thereby reducing a level of crosstalk between the sub-pixels adjacent to one another.

In another aspect, a circuit comprises a power supply unit configured to supply a VDD signal; a first VDD line configured to transmit the VDD signal to a gamma voltage generator; a second VDD line configured to transmit the VDD signal to a data driver; and a horizontal crosstalk compensation unit configured to filter high frequency content of the VDD signal which is transmitted to the gamma voltage generator.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
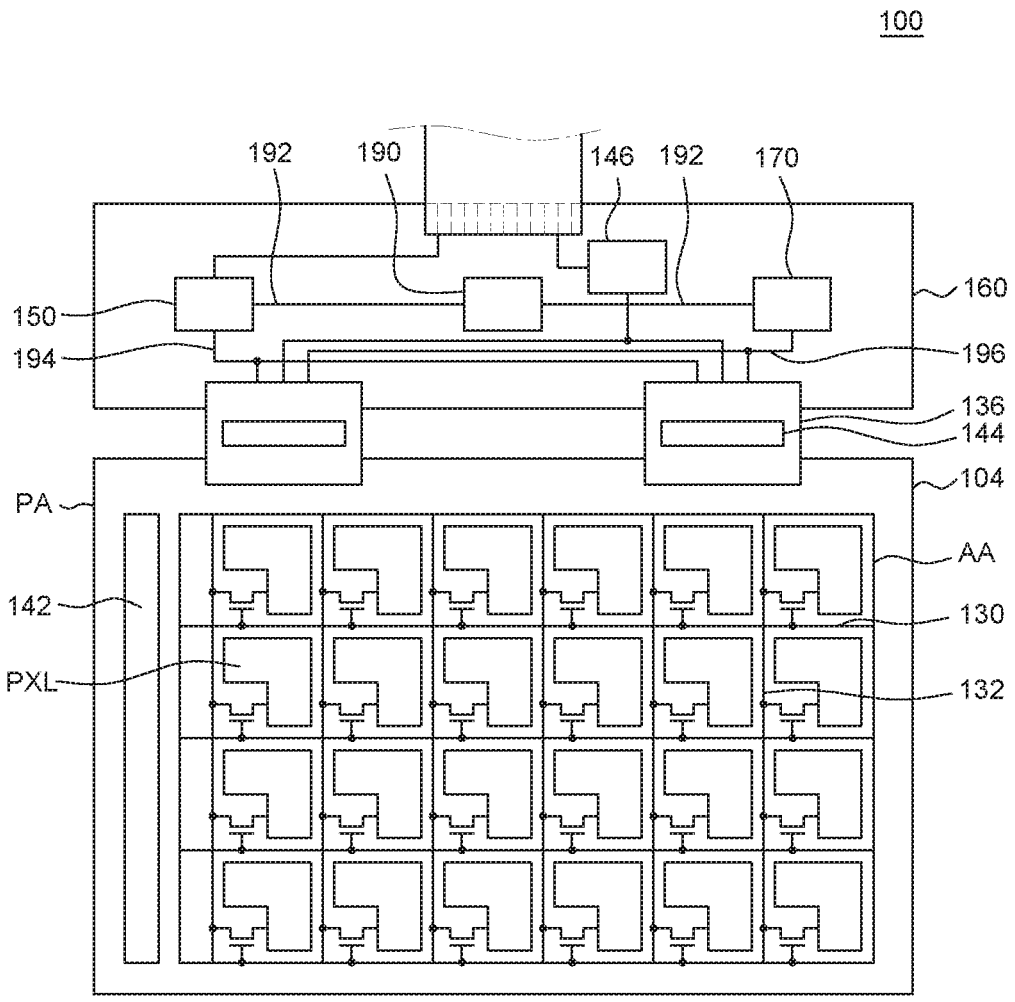
FIG. 1 is a schematic diagram of a liquid crystal display apparatus according to an exemplary embodiment of the present disclosure.

Advantages and features of the present disclosure and methods for accomplishing the same will be more clearly understood from exemplary embodiments described below with reference to the accompanying drawings. However, the present disclosure is not limited to the following exemplary embodiments but may be implemented in various different forms. The exemplary embodiments are provided only to complete the description of the present disclosure and to provide an explanation to a person having ordinary skill in the art as to how to practice various features, whereby the scope of protection will be defined by the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the present specification. Further, in the following description, a detailed explanation of known related technologies may be omitted to avoid unnecessarily obscuring the subject matter of the present disclosure. The terms such as "including", "having", "comprising" and "consist of" used herein are generally intended to allow other components to be added unless the terms are used with the term "only". Any references to singular may include plural unless expressly stated otherwise.

Components are interpreted to include an ordinary error range or an ordinary tolerance range even if not expressly stated.

When the position relation between two parts is described using the terms such as "on", "above", "below", and "next", on or more parts may positioned between the two parts unless the terms are used with the term "immediately" or "directly".

When an element or layer is referred to as being "on" another element or layer, it may be directly on the other element or layer, or intervening elements or layers may be present.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Throughout the whole specification, the same reference numerals denote the same elements.

Since the size and thickness of each component illustrated in the drawings are represented for convenience in explanation, the present disclosure is not necessarily limited to the illustrated size and thickness of each component.

The features of various embodiments of the present disclosure can be partially or entirely connected to or combined with each other and can be interlocked and operated in technically various ways as can be fully understood by a person having ordinary skill in the art, and the embodiments can be carried out independently of or in association with each other.

Various exemplary embodiments of the present disclosure will be described in detail with reference to the accompanying drawings.

FIG. 1 is a schematic diagram of a liquid crystal display apparatus according to an exemplary embodiment of the present disclosure. A liquid crystal display apparatus 100 according to an exemplary embodiment of the present disclosure includes a liquid crystal panel 104 and a driving circuit board 160.

Referring to FIG. 1, the liquid crystal panel 104 is briefly disclosed. The liquid crystal panel 104 is a passive device which is not self-emissive.

The liquid crystal panel 104 comprises at least a first polarizer, a first substrate, a liquid crystal layer, a second substrate and a second polarizer.

The liquid crystal panel 104 may be divided into an active area AA and a periphery area PA. The active area AA comprises a plurality of sub-pixels PXL configured to display an image. The periphery area PA is configured to surround the active area AA. Various circuits and wires may be in the periphery area PA and to be used to drive each of the plurality of sub-pixels PXL of the active area AA. In the present disclosure, the sub-pixel PXL is the minimal unit of the active area AA of the liquid crystal display apparatus 100 for displaying an image.

At least a plurality of gate lines 130, a plurality of data lines 132 and a plurality of sub-pixels PXL are positioned in the active area AA. The gate line 130 may be extended along with the first direction of the active area AA. The data line 132 may be extended along the second direction of the active area AA.

The light transmittance (%) of the sub-pixel PXL is adjusted according to the level of the image signal input from the data driver 144.

The first polarizer is positioned on the rear (or lower) side of the first substrate and configured to polarize the light incident on the first substrate. The second polarizer is positioned on the front (or upper) side of the second substrate and configured to polarize the light passing through the second substrate.

A gate driver 142 and a flexible circuit board 136 are positioned at the periphery area PA of the first substrate. A data driver 144 may be positioned on the flexible circuit board 136. The liquid crystal panel 104 and the driving circuit board 160 are connected to each other by the flexible circuit board 136. The color filter is positioned at the second substrate. That is, the first substrate may be defined as an array substrate and the second substrate may be defined as a color filter substrate.

The gate driver 142 is configured to supply driving signals to a plurality of gate lines 130 and activate the sub-pixels PXL within the active area AA.

The gate driver 142 is configured to be positioned at least on one side of the periphery area PA of the liquid crystal display apparatus 100. The gate driver 142 is configured to receive various control signals from the data driver 144, and configured to control the liquid crystal panel 104 for displaying an image at the active area AA of the liquid crystal display apparatus 100. The gate driver 142 is configured to be electrically connected to the plurality of gate lines 130.

The gate driver 142 can be implemented in the form of gate-driver in panel (GIP) configuration. The gate driver 142 may be a semi-conductor chip which has a specific number of channels and positioned on the periphery area PA of the first substrate in a form of chip on film (COF) or chip on glass (COG) configuration.

The flexible circuit board 136 is configured to receive the digital image signals and transfer such to the data driver 144. The flexible circuit board 136 may be adhered to the liquid crystal panel 104 and the driving circuit board 160 by an anisotropic conductive film (ACF).

The data driver 144 is configured to supply the image signal to the active area AA. To supply the image signal, the data driver 144 is configured to be electrically connected to the sub-pixels PXL through the data lines 132. The data driver 144 receives gamma voltages from the gamma voltage generator 170, and then converts the digital image signal into analogue voltage.

The data drive 144 is configured to control the gate driver 142. To control the gate driver 142, the data driver 144 is configured to be electrically connected to the gate driver 142. But the present disclosure is not limited thereto, and the gate driver 142 may be directly controlled by a controller 146.

Referring to FIG. 1, the driving circuit board 160 is shown. The driving circuit board 160 comprises at least a first VDD line 192, a second VDD line 194, a gamma voltage line 196, a controller 146, a power supply unit 150, a gamma voltage generator 170 and a horizontal crosstalk compensation unit 190. The particular widths and number of lines (i.e., electrical wires) illustrated in FIG. 1 are merely schematic for the convenience of the explanation, and the present disclosure is not limited thereto. For example, the gamma voltage line 196 may include a group of 16 lines for supplying 16 different reference voltages.

The controller 146 is configured to control intervals and frequencies of the digital image signals and control signals, thereby inputting the received digital image signals into the sub-pixels PXL of the active area AA. That is, the controller 146 can function as a timing controller such that the timing of the image signal is controlled, thereby an image is properly displayed on the active area AA of the liquid crystal panel 104. In other words, the controller 146 transmits the image signal in which arranged in a digital format to the data driver 144.

The power supply unit 150 generates various power signals for operating the liquid crystal display apparatus 100. The power supply unit 150 generates a VDD signal as a representative power signal. The VDD signal is an important signal used by the gamma voltage generator 170 and the data driver 144. The VDD signal generated from the power supply unit 150 is supplied to the gamma voltage generator 170 and the data driver 144 with a specific voltage and a specific current. In particular, since the gamma voltage is generated based on the VDD signal, if the voltage of the VDD signal is shifted or distorted, gamma voltages generated from the gamma voltage generator 170 are also shifted or distorted. Thus, an image quality of the liquid crystal display apparatus 100 which expresses the gray levels based on the gamma voltage is degraded. Furthermore, the power supply unit 150 may generate a gate high voltage (VGH) and a gate low voltage (VGL) and supply the gate high voltage (VGH) and the gate low voltage (VGL) to the gate driver 142.

The power supply unit 150 is further configured to supply direct current (DC). For example, the power supply unit 150 may be comprised of a buck boost element, a DC-DC converter, a switching regulator or the like. But the present disclosure is not limited thereto. The power supply unit 150 may be a feedback system such that the voltage of the VDD signal is adjusted in real time for maintaining the voltage of the VDD signal based upon feedback. In other words, if the voltage of the VDD signal is more than the target voltage of the VDD signal, the feedback system of the power supply unit 150 decreases the voltage of the VDD signal to the target voltage in an instant and if the voltage of the VDD signal is less than the target voltage of the VDD signal, the feedback system of the power supply unit 150 increases the voltage of the VDD signal to the target voltage in an instant. Thus, the output voltage of the VDD signal may slightly deviate within a specific range from the target VDD voltage. As such, the VDD signal may include so-called ripple portions.

The power supply unit 150 is connected to the gamma voltage generator 170 through the first VDD line 192. The first VDD line 192 is a dedicated signal line for the gamma voltage generator 170 and configured to supply the first VDD signal to the gamma voltage generator 170.

The power supply unit 150 is connected to the data driver 144 through the second VDD line 194. The second VDD line 194 is a dedicated signal line for the data driver 144 and configured to supply the second VDD signal to the data driver 144. Thus, the power supply unit 150 is configured to supply the first VDD signal to the gamma voltage generator 170 and the second VDD signal to the data driver 144. According to the configuration as described above, the first and second VDD lines are separated. Thus, a coupling phenomenon between the data driver 144 and the gamma voltage generator 170 is effectively reduced by such separation of the first and second VDD lines. Therefore, interference between the first VDD signal and the second VDD signal is reduced.

The gamma voltage line 196 is configured to supply the gamma voltage generated from the gamma voltage generator 170 to the data driver 144.

The gamma voltage generator 170 generates the gamma voltage that is supplied to the data driver 144. The gamma voltage is the reference voltage used for converting digital image signals into analogue image signals. The gamma voltage may be defined as gamma reference voltages. For example, the gamma voltage may be configured to generate 256 gray level voltages (i.e., gradation steps) to express an image signal with 8-bits gray levels or the gamma voltage may be configured to express an image signal with 10-bit gray levels. But the present disclosure is not limited thereto and the number of gray level voltage can vary. Furthermore, the gamma voltage generator 170 need not generate the number of gamma voltages corresponding to all of the gray levels. For example, the gamma voltage generator 170 could simply generates only 16 gamma voltages and the data driver 144 can be configured to generate all necessary gray level voltages based on the 16 gamma voltages.

The horizontal crosstalk compensation unit 190 is connected to the first VDD line 192, which connects the power supply unit 150 and the gamma voltage generator 170, and thereby ripples in the current of the first VDD signal input to the gamma voltage generator 170 can be suppressed such that horizontal crosstalk can be reduced or eliminated. That is, the horizontal crosstalk compensation unit 190 is configured to reduce the level of the horizontal crosstalk. To be more specific, ripples occur in the current of the first VDD signal input to the gamma voltage generator 170 when the load at the liquid crystal panel 104 is increased. At such time, an electromagnetic induction phenomenon occurs at the horizontal crosstalk compensation unit 190. According to this phenomenon, a counter electromotive force (i.e., backward or reverse electromotive force) which is capable of filtering the ripples of the current of the first VDD signal is generated by the horizontal crosstalk compensation unit 190. Consequently, the voltage of the first VDD signal is stabilized as a result of the stabilized (i.e. ripple-filtered) current of the first VDD signal. Therefore, the level of the horizontal crosstalk of the liquid crystal display apparatus 100 can be decreased. For example, the horizontal crosstalk compensation unit 190 is positioned at the input side of the gamma voltage generator 170.

Figure 2:
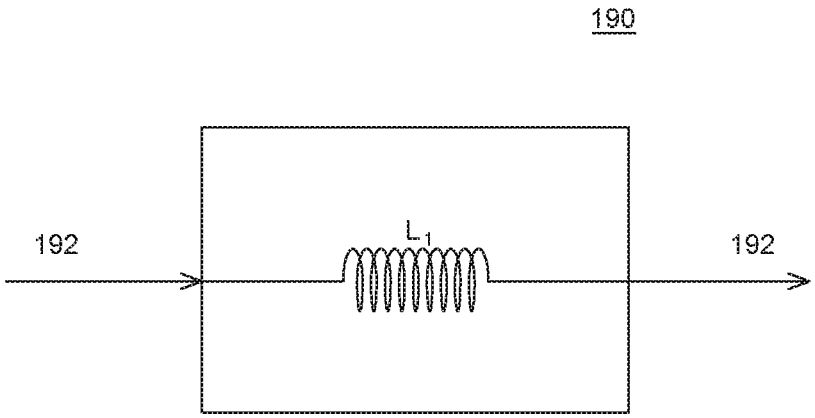
FIG. 2 is a schematic diagram of a horizontal crosstalk compensation unit of the liquid crystal display apparatus according to an exemplary embodiment of the present disclosure.

Referring to FIG. 2, a circuit configuration of the horizontal crosstalk compensation unit 190 is shown in detail.

The horizontal crosstalk compensation unit 190 comprises a first coil L1. According to the configuration as described above, the horizontal crosstalk compensation unit 190 can have the filtering ability of the ripples of the current of the first VDD signal. To be more specific, if ripples are generated in the first VDD signal, the direction and the flow of the current are alternatively shifted and such can be referred to as high frequency contents. However, the horizontal crosstalk compensation unit 190 interrupts such alternative shift, thereby stabilizing the VDD signal. That is, the horizontal crosstalk compensation unit 190 filters the high frequency contents of the first VDD signal, thereby effectively filtering the ripples of the current of the first VDD signal.

Referring to FIG. 3A to FIG. 3D, a horizontal crosstalk phenomenon of a liquid crystal display apparatus 100 according to an exemplary embodiment of the present disclosure is described.

Figure 3A:
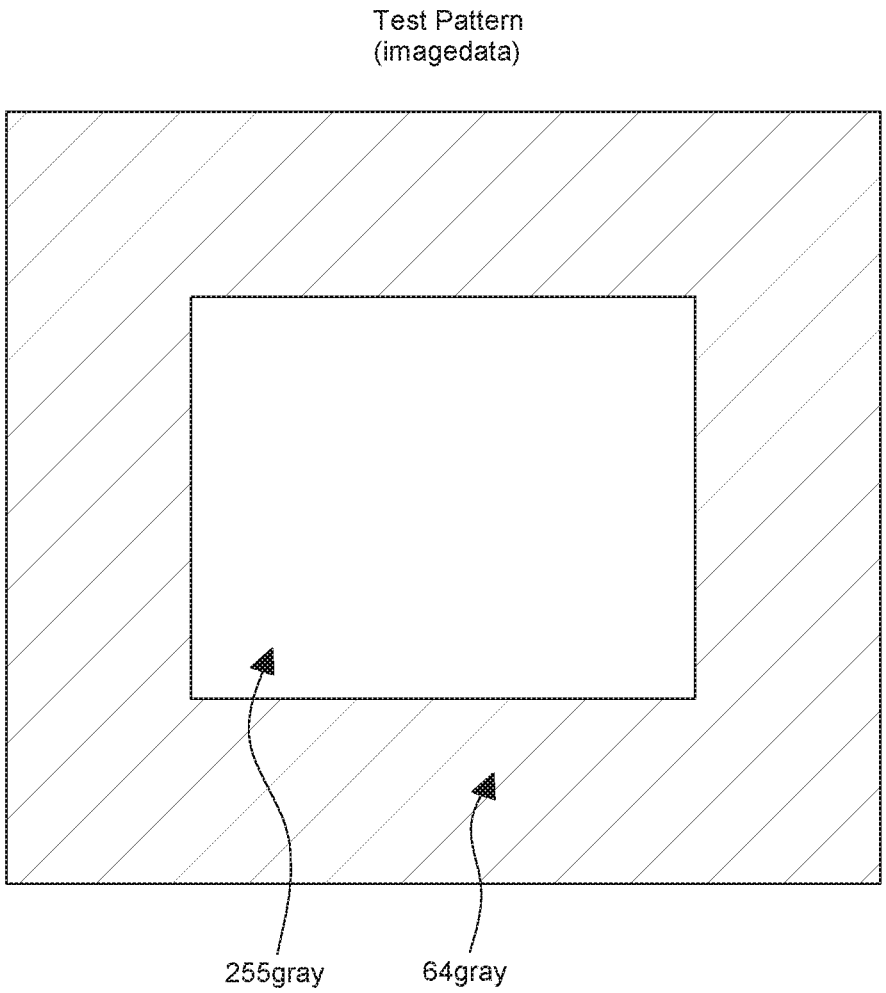
FIG. 3A is an exemplary test pattern used for inspecting horizontal crosstalk of the liquid crystal display apparatus.

FIG. 3A is an exemplary test pattern displayed on the liquid crystal display apparatus 100. This kind of the test pattern is used for testing for horizontal crosstalk that may be undesirably displayed on the liquid crystal panel 104, by measuring the level of the horizontal crosstalk being generated. There may be a rectangular area at the center of the test pattern. The gray level of this rectangular area may be the maximum gray level for displaying the maximum brightness, such as 255 gray levels. But the present disclosure is not limited thereto. The gray level of the periphery area of the test pattern may be less than the gray level of the rectangular area at the central for displaying dimmer brightness, such as 64 gray levels. However, the particular gray level as described above are merely exemplary, and the present disclosure is not limited thereto.

For example, the required current to charge the high gray level area of the test pattern may be 400 mA and the required current to charge the low gray level area of the test pattern may be 200 mA.

Figure 3B:
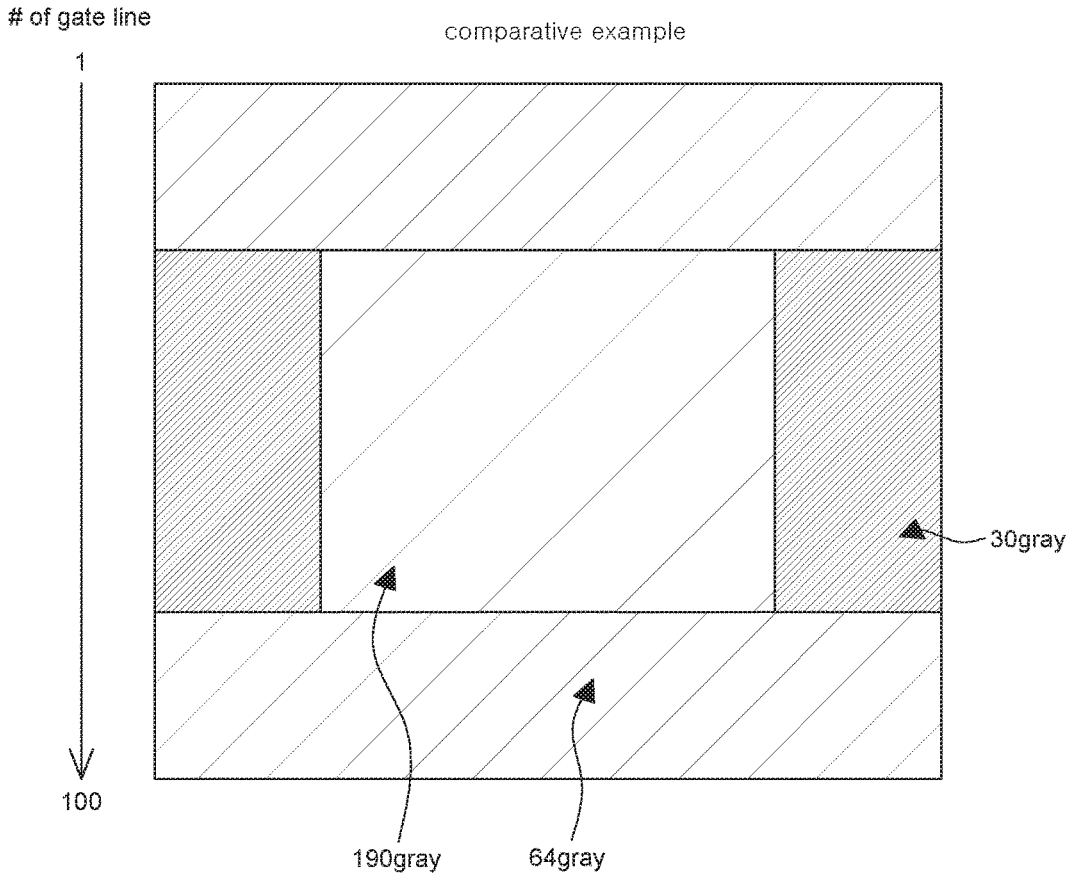
FIG. 3B is a schematic diagram illustrating the horizontal crosstalk phenomenon when the exemplary test pattern of FIG. 3A is displayed on the liquid crystal display apparatus displaying according to a comparative example.

FIG. 3B is a comparative example for explaining the horizontal crosstalk phenomenon. The liquid crystal panel of the comparative example may be an in-plane switching (IPS) type liquid crystal panel. This kind of the liquid crystal panel may be configured to display a black image when the gray level is 0. Such liquid crystal panel may be referred as a normally black liquid crystal panel. This kind of liquid crystal panel displays a black image when the current is not charged. Thus, more current is required for displaying a high gray level image than displaying a low gray level image. That is, relatively more current is required for displaying high gray level area at the central rectangular area.

Accordingly, more current is required to the data driver of the comparative example. That is, this phenomenon may be caused by the increased liquid crystal panel load according to the high gray level image signal.

Figure 3C:
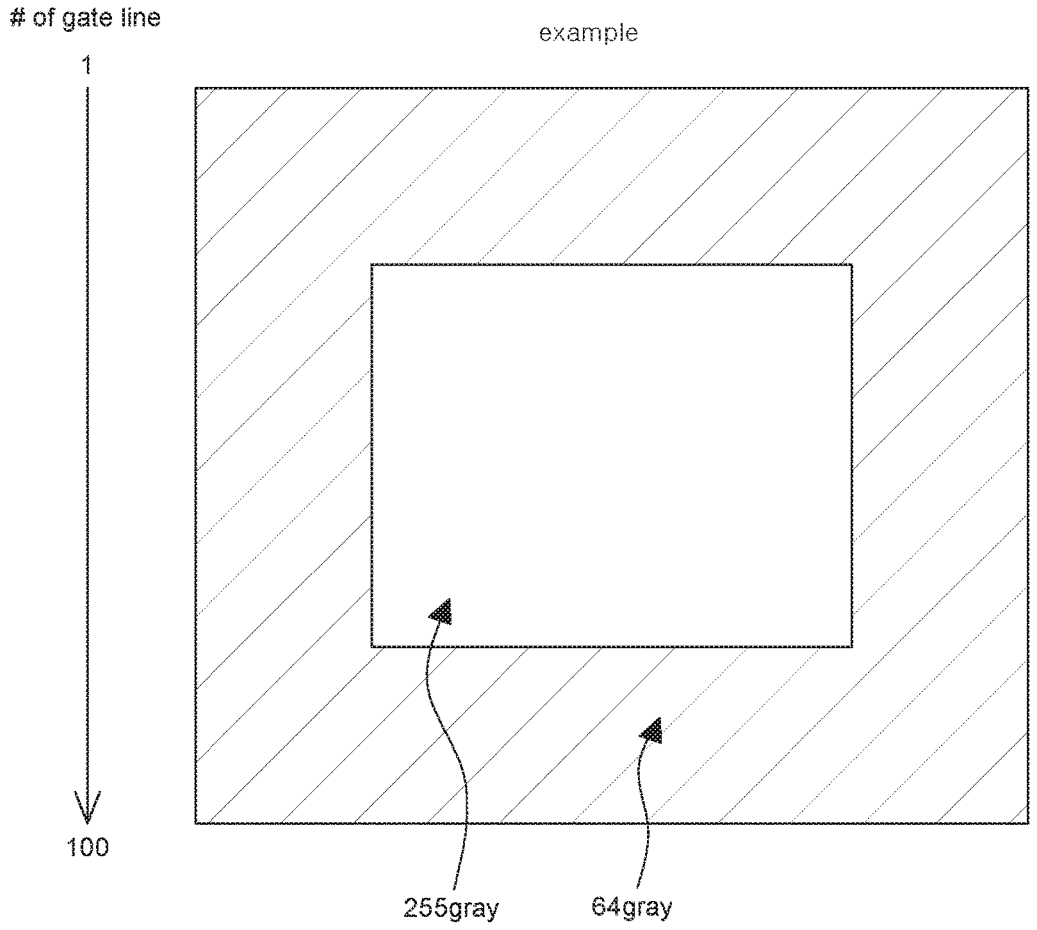
FIG. 3C is a schematic diagram illustrating the compensated horizontal crosstalk phenomenon when the exemplary test pattern of FIG. 3A is displayed on the liquid crystal display apparatus displaying according to an exemplary embodiment of the present disclosure.

Referring to FIG. 3B and FIG. 3C, the number of the gate lines 130 is briefly illustrated, but this is merely exemplary, and the present disclosure is not limited thereto.

The comparative example as illustrated in FIG. 3B briefly illustrates that the test pattern of FIG. 3A is displayed on the liquid crystal panel of the comparative example. However, the liquid crystal panel of the comparative example does not include the horizontal crosstalk compensation unit 190 of the exemplary embodiment in the present disclosure. Furthermore, the VDD signal is configured to be supplied to the gamma voltage generator and the data driver of the comparative example by one VDD line. According to the comparative example, if the VDD signal is supplied to the gamma voltage generator and the data driver through one VDD line, the data driver requires a large amount of current. Thus the voltage of the VDD signal is decreased and the decreased voltage of VDD signal is supplied to the gamma voltage generator. Consequently, the gamma voltage generator generates a gamma voltage based on the decreased voltage of the VDD signal, thereby causing horizontal crosstalk.

The theory of the voltage decrease of the VDD signal due to the increased panel load can be explained by the equation $P=VI$, wherein P is power, V is voltage and I is current. That is, the power applied to the liquid crystal panel 102 equals the voltage multiplied by the current. Thus, if the current is increased due to the increased panel load, then the voltage is decreased.

Referring to FIG. 3B, the horizontal crosstalk is depicted as occurring in the area corresponding to central rectangular portion of high gray level. For example, the gray level at the horizontal crosstalk area is decreased from 64 gray levels to 30 gray levels. Moreover, the gray level of the high gray level area is decreased from 255 gray levels to 190 gray levels. The reason for this result is because of the gamma voltage generated based on the VDD signal is affected when the voltage of the VDD signal input from the gamma voltage generator 170 is decreased.

Particularly, if the test pattern as illustrated in FIG. 3A is displayed on the liquid crystal panel of the comparative example of FIG. 3B, the gate driver sequentially scans from the first gate line to the $n^{th}$ gate line, thereby charging the sub-pixels PXL connected to the each gate line. The required amount of the current is increased for the sub-pixels connected to the gate lines from the starting portion to the end portion of the high gray level area at the center. Accordingly, the voltage of the VDD signal is decreased from the corresponding gate line because the required amount of the current which is supplied from the power supply unit is increased. The degree of the voltage drop of the VDD signal may be proportional to the horizontal width of high gray level area of the test pattern. Thus, if this kind of the test pattern may show that the image quality of the liquid crystal panel can deteriorate.

Referring to FIG. 3C, the liquid crystal display apparatus 100 according to an embodiment of the present disclosure is capable of substantially suppressing the horizontal crosstalk.

Figure 3D:
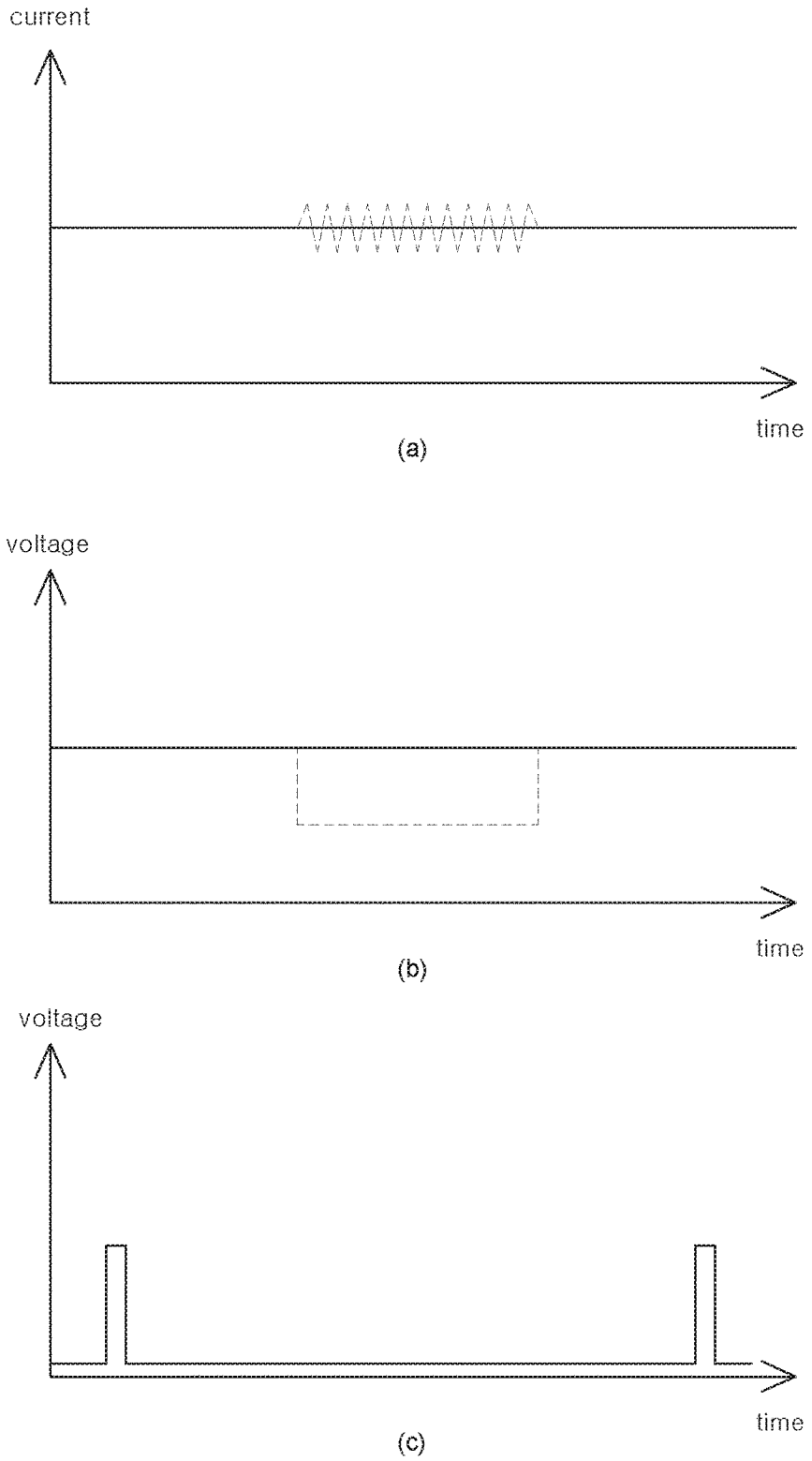
FIG. 3D is a schematic waveform comparing outputs of the gamma voltage generator corresponding to a data line associated with sub-pixels for a comparative example of FIG. 3B and an exemplary embodiment of the present disclosure of FIG. 3C.

Referring to FIG. 3D, features of the horizontal crosstalk compensation unit 190 are described in more detail.

For example, part (a) of FIG. 3D schematically illustrates a waveform, in which the amount of current flow of the first VDD signal input to the gamma voltage generator 170 for a period of sequential scanning from the top-most gate line to the bottom-most gate line such as the first gate line 130 to the $100^{th}$ gate line 130 as illustrated in FIG. 3C.

For example, part (b) of FIG. 3D schematically illustrates a waveform, in which the level of voltage of the first VDD signal input to the gamma voltage generator 170 for a period of sequential scanning from the top gate line to the bottom gate line such as the first gate line 130 to the $100^{th}$ gate line 130 as illustrated in FIG. 3C.

The dashed line in part (a) of FIG. 3D represents the amount of current flow of the VDD signal of the comparative example. The solid line in part (a) of FIG. 3D represents the amount of current flow of the first VDD signal of an exemplary embodiment of the present disclosure. In case of the comparative example, ripples occurred in the current of the VDD signal corresponding to the high gray level area. However, ripples in the current of the first VDD signal corresponding to the high gray level area are effectively suppressed by the horizontal crosstalk compensation unit 190 according to an exemplary embodiment of the present disclosure.

The dashed line in part (b) of FIG. 3D represents the voltage level of the VDD signal of the comparative example. The solid line in part (b) of FIG. 3D represents the voltage level of the first VDD signal of an exemplary embodiment of the present disclosure. In case of the comparative example, the voltage level of the VDD signal corresponding to the high gray level area is reduced. However, the voltage level of the first VDD signal corresponding to the high gray level area is effectively maintained by the horizontal crosstalk compensation unit 190 according to an exemplary embodiment of the present disclosure.

The solid line in part (c) of FIG. 3D represents the gate start pulse (GSP). As the gate start pulse is applied, scanning is performed from the first gate line 130 to the $100^{th}$ gate line 130 in a sequential manner with respect to time.

In summary, the amount of current flow of the first VDD signal and the voltage level of the first VDD signal are maintained in a stable manner. Moreover, the horizontal crosstalk compensation unit 190 filters the ripple in the current of the first VDD signal, thereby suppressing ripples from causing problems while scanning the high gray level area. Thus, the liquid crystal display apparatus 100 is capable of providing the first VDD signal to the gamma voltage generator 170 in a stable manner. According to the configuration described above, there is an advantage of compensating the horizontal crosstalk up to the substantial elimination level as briefly illustrated in FIG. 3C.

In addition, even if ripples exist in the second VDD signal supplied through the second VDD line 194 input to the data driver 144, the ripples in the first VDD signal supplied through the first VDD line 192 are effectively filtered by the horizontal crosstalk compensation unit 190. Thus, the gamma voltage generator 170 can generate the gamma voltage in a stable manner.

Figure 4A:
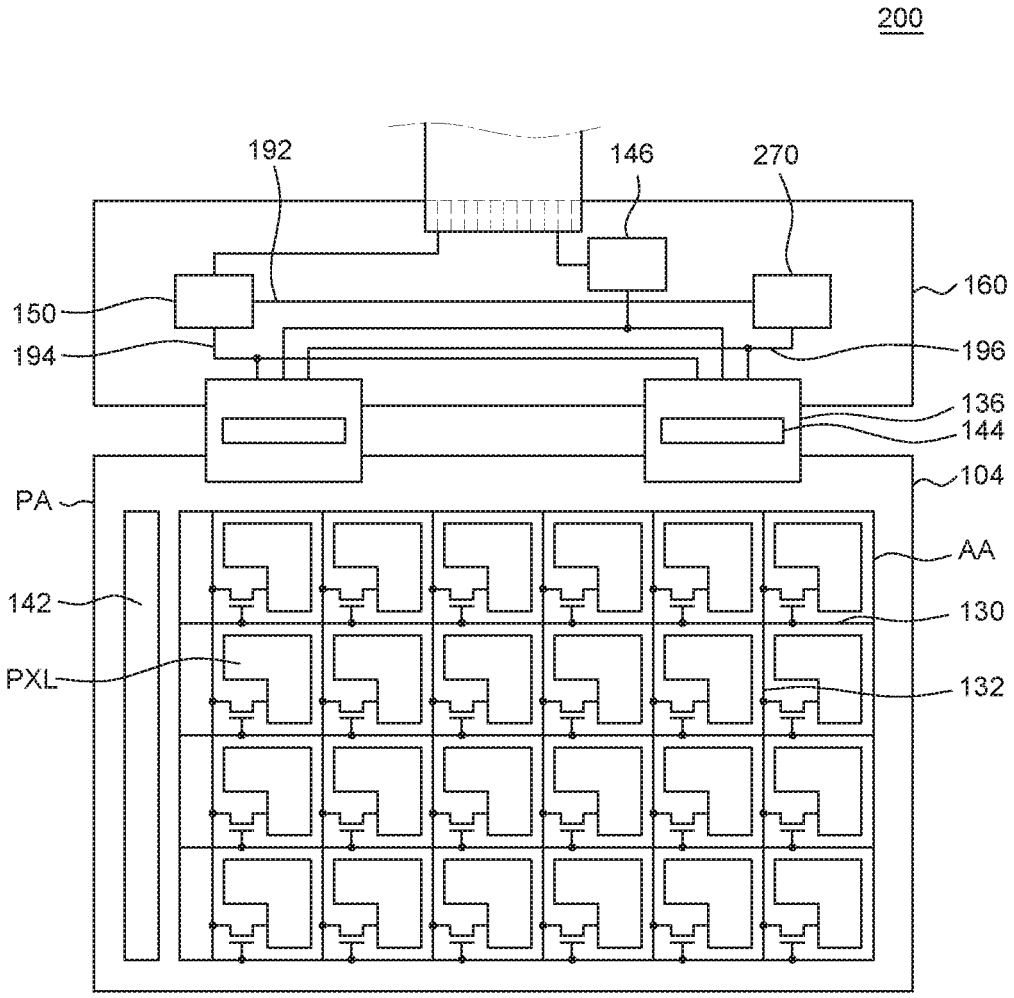
FIG. 4A is a schematic diagram illustrating an another exemplary embodiment of the present disclosure.
Figure 4B:
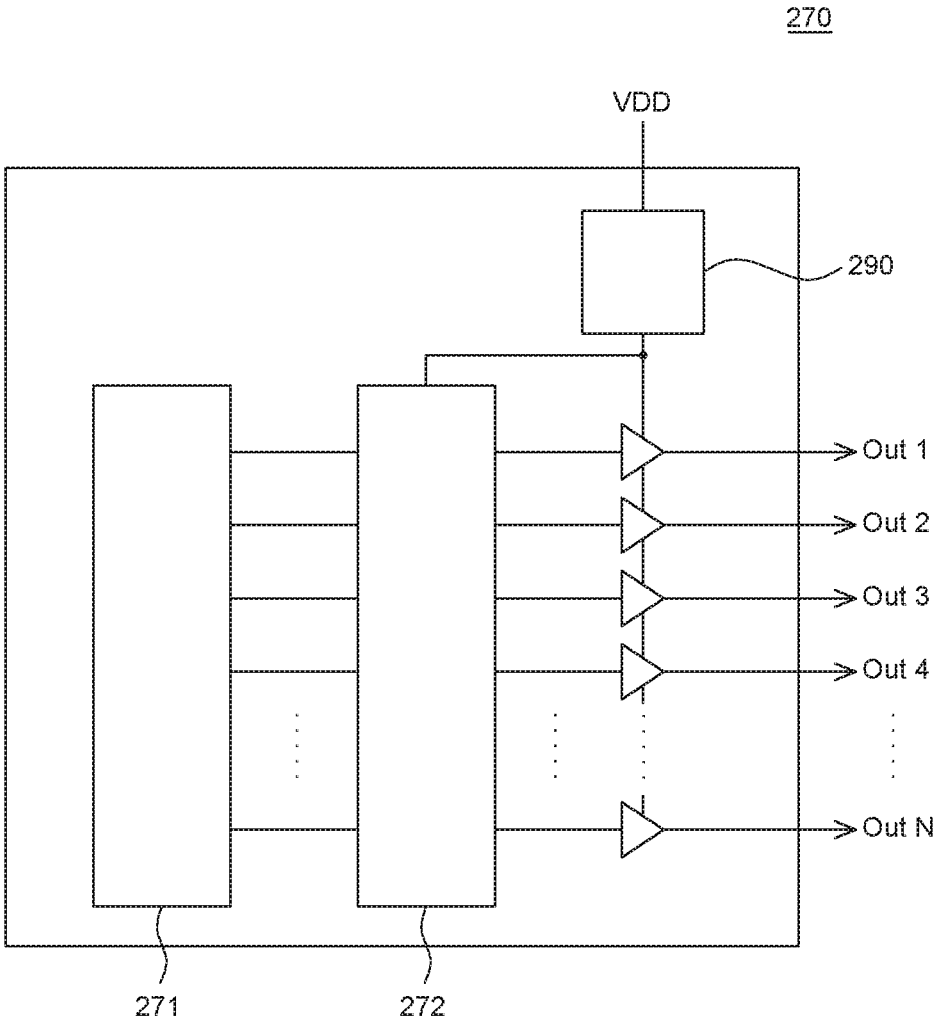
FIG. 4B is a schematic diagram illustrating the gamma voltage generator of FIG. 4A.

FIG. 4A and FIG. 4B briefly illustrate the liquid crystal display apparatus 200 according to another exemplary embodiment of the present disclosure. Referring to FIG. 4A, the gamma voltage generator 270 is configured to comprise a bank 271, a digital to analogue converter (DAC) 272 and a horizontal crosstalk compensation unit 290. The bank 271 is configured to receive the desired gamma voltage information from the controller 146. The digital to analogue converter 272 generates the predetermined gamma voltage. The digital to analogue converter 272 generates a plurality of gamma voltages from Out 1 to Out N, wherein N is an integer. The digital to analogue converter 272 is configured to receive the filtered VDD signal by the horizontal crosstalk compensation unit 290 and generate the gamma voltage. According to the configuration described above, the gamma voltage generator 270 has an advantage of including the horizontal crosstalk compensation unit 290.

With the exception of the features as described in FIG. 4A and FIG. 4B, in which the horizontal crosstalk compensation unit 290 is embedded into the gamma voltage generator 270, the liquid crystal display apparatus 200 according to another exemplary embodiment of the present disclosure is substantially identical to the liquid crystal display apparatus 100 according to an exemplary embodiment of the present disclosure, and thus redundant features will be omitted merely for the sake of brevity.

The exemplary embodiments of the present disclosure can also be described as follows:

According to an aspect of the present disclosure, there is provided a liquid crystal display apparatus comprising: a plurality of sub-pixels configured to be operated by a gate signal provided from a gate driver via a gate line and an image signal provided from a data driver via a data line; a gamma voltage generator configured to supply gamma reference voltages for expressing gray levels to the data driver; a power supply unit configured to supply a first VDD signal to the gamma voltage generator and a second VDD signal to the data driver; and a horizontal crosstalk compensation unit configured to filter a ripple of the first VDD signal such that voltage of the first VDD signal is stabilized to thereby reduce a level of crosstalk between the sub-pixels adjacent to one another.

The horizontal crosstalk compensation unit may be positioned between the power supply unit and the gamma voltage generator.

The horizontal crosstalk compensation unit may be comprised in the gamma voltage generator.

The gamma voltage generator may further comprise a bank and a digital to analogue converter (DAC), the bank is configured to receive gamma reference voltages information from a controller, the digital to analogue converter is configured to receive the filtered first VDD signal by the horizontal crosstalk compensation unit and generate the gamma reference voltages.

The liquid crystal display apparatus may further comprise a circuit board, wherein the power supply unit, the horizontal crosstalk compensation unit and the gamma voltage generator are on the circuit board, a first VDD line configured to transfer the first VDD signal from the power supply unit to the gamma voltage generator is formed on the circuit board, and a second VDD line configured to transfer the second VDD signal from the power supply unit to the data driver is formed on the circuit board.

The horizontal crosstalk compensation unit may be configured to filter high frequency content (i.e., ripples) of the first VDD signal supplied from the power supply and transferred through the first VDD line.

The crosstalk compensation unit may be configured with at least a first coil component.

According to another aspect of the present disclosure, there is provided a circuit comprising: a power supply unit configured to supply a VDD signal; a first VDD line configured to transfer the VDD signal to a gamma voltage generator; a second VDD line configured to transfer the VDD signal to a data driver; and a horizontal crosstalk compensation unit configured to filter high frequency components of the VDD signal provided to the gamma voltage generator.

The horizontal crosstalk compensation unit may be positioned at the first VDD line.

The horizontal crosstalk compensation unit may be comprised in the gamma voltage generator.

The gamma voltage generator may further comprises a bank and a digital to analogue converter (DAC), the bank is configured to receive gamma reference voltages information from a controller, the digital to analogue converter is configured to receive the filtered VDD signal by the horizontal crosstalk compensation unit and generate gamma reference voltages.

The horizontal crosstalk compensation unit may be configured to stabilize a voltage of the first VDD line.

According to another aspect of the present disclosure, there is provided Apparatus comprising a liquid crystal display (LCD) panel configured to output images with undesirable horizontal crosstalk effects being suppressed as a result of minimizing extreme changes in current that is applied in the LCD panel by using electromagnetic induction, said minimizing extreme changes in current being achieved by employing a $V_{DD}$ signal having high frequency components effectively removed therefrom, and said $V_{DD}$ signal being transferred via at least one among a first dedicated $V_{DD}$ signal line and a second dedicated Vdd signal line, respectively provided on said LCD panel.

The first dedicated $V_{DD}$ signal line provided on said LCD panel may be configured to carry signals for a gamma voltage generator.

The second dedicated $V_{DD}$ signal line provided on said LCD panel may be configured to carry signals for a data driver.

At least one among said first and second dedicated Vdd signal lines may carry said $V_{DD}$ signal having said high frequency components effectively removed therefrom by a horizontal crosstalk compensation unit, which is connected with said LCD panel, that filters ripples from said $V_{DD}$ signal.

According to the present disclosure, embodiments of the present invention may provide an advantage of reducing the level of the horizontal crosstalk by generating electromagnetic induction phenomenon when an extreme current flow change is occurred in the liquid crystal display apparatus by providing an independent VDD line for the data driver, an another independent VDD line for the gamma voltage generator and a horizontal crosstalk compensation unit capable of suppressing ripples of current of the VDD signal input to the gamma voltage generator, thereby stabilizing the voltage of the VDD signal.

It will be apparent to those skilled in the art that various modifications and variations can be made in the liquid crystal display apparatus of the present invention without departing from the spirit or scope of the invention. Thus, it is intended that the present invention cover the modifications and variations of this invention provided they come within the scope of the appended claims and their equivalents.

What is claimed is:

1. A liquid crystal display apparatus, comprising:

a liquid crystal display (LCD) panel including a plurality of sub-pixels configured to be operated by a gate signal provided from a gate driver via a gate line and an image signal provided from a data driver via a data line;

a driving circuit board, including:

a gamma voltage generator configured to supply gamma reference voltages for expressing gray levels to the data driver;

a power supply unit configured to supply a first high operating voltage (VDD) signal excluding a common voltage (Vcom) to the gamma voltage generator and a second VDD signal to the data driver; and a horizontal crosstalk compensation circuit configured to filter a ripple of the first VDD signal supplied from the power supply unit on the driving circuit board such that voltage of the first VDD signal is stabilized to thereby reduce a level of crosstalk between the sub-pixels adjacent to one another; and a flexible circuit board connecting the driving circuit board with the LCD panel, wherein the data driver is on the flexible circuit board, and the gamma voltage generator supplies the gamma reference voltages to the flexible circuit board having the data driver thereon.

2. The liquid crystal display apparatus of claim 1, wherein the horizontal crosstalk compensation circuit is positioned between the power supply unit and the gamma voltage generator.

3. The liquid crystal display apparatus of claim 1, wherein the horizontal crosstalk compensation unit is comprised in the gamma voltage generator.

4. The liquid crystal display apparatus of claim 1, wherein the gamma voltage generator further comprises a bank and a digital to analogue converter (DAC), the bank is configured to receive gamma reference voltages information from a controller, the digital to analogue converter is configured to receive the filtered first VDD signal by the horizontal crosstalk compensation unit and generate the gamma reference voltages.

5. The liquid crystal display apparatus of claim 1, wherein the power supply unit, the horizontal crosstalk compensation circuit and the gamma voltage generator are on the driving circuit board, wherein a first VDD line configured to transfer the first VDD signal from the power supply unit to the gamma voltage generator is on the driving circuit board, and wherein a second VDD line configured to transfer the second VDD signal from the power supply unit to the data driver is on the driving circuit board.

6. The liquid crystal display apparatus of claim 5, wherein the horizontal crosstalk compensation circuit is configured to filter high frequency content of the first VDD signal supplied from the power supply unit and transferred through the first VDD line.

7. The liquid crystal display apparatus of claim 5, wherein the horizontal crosstalk compensation circuit is connected to the first VDD line.

8. The liquid crystal display apparatus of claim 1, wherein the crosstalk compensation unit is configured with at least a first coil component.

9. The liquid crystal display apparatus of claim 1, wherein the horizontal crosstalk compensation circuit filters the ripple in a current of the VDD signal while scanning a high gray level area.

10. A circuit, comprising:

a power supply unit configured to supply a high operating voltage (VDD) signal excluding a common voltage (Vcom);

a first VDD line configured to transfer the VDD signal to a gamma voltage generator;

a second VDD line configured to transfer the VDD signal to a data driver; and a horizontal crosstalk compensation circuit configured to filter high frequency components of the VDD signal supplied from the power supply unit on a circuit board and provided to the gamma voltage generator on the circuit board, wherein a flexible circuit board connects the circuit board with a liquid crystal display panel, and wherein the gamma voltage generator supplies the gamma reference voltages to the flexible circuit board having the data driver on the flexible circuit board.

11. The circuit of claim 10, wherein the horizontal crosstalk compensation circuit is positioned at the first VDD line.

12. The circuit of claim 10, wherein the horizontal crosstalk compensation unit is comprised in the gamma voltage generator.

13. The circuit of claim 10, wherein the gamma voltage generator further comprises a bank and a digital to analogue converter (DAC), the bank is configured to receive gamma reference voltages information from a controller, the digital to analogue converter is configured to receive the filtered VDD signal by the horizontal crosstalk compensation unit and generate gamma reference voltages.

14. The circuit of claim 10, wherein the horizontal crosstalk compensation circuit is configured to stabilize a voltage of the first VDD line.

15. The circuit of claim 10, wherein the horizontal crosstalk compensation circuit is configured with at least a first coil component.

16. The circuit of claim 10, wherein the horizontal crosstalk compensation circuit filters the ripple in a current of the VDD signal while scanning a high gray level area.

17. An apparatus comprising:

a liquid crystal display (LCD) panel configured to output images with undesirable horizontal crosstalk effects being suppressed as a result of reducing extreme changes in current that is applied in the LCD panel by using electromagnetic induction, wherein the reducing extreme changes in current is achieved by employing a high operating voltage (VDD) signal excluding a common voltage (Vcom) and having high frequency components effectively removed therefrom, wherein the VDD signal is transferred via at least one among a first dedicated VDD signal line and a second dedicated VDD signal line, respectively provided to the LCD panel from a gamma voltage generator on a driving circuit board, wherein at least one among the first and second dedicated VDD signal lines have the high frequency components effectively removed therefrom by a horizontal crosstalk compensation circuit on the driving circuit board that filters ripples from the VDD signal supplied from a power supply unit on the driving circuit board, and wherein a flexible circuit board connects the driving circuit board with the LCD panel, and wherein the flexible circuit board includes a data driver thereon, and the gamma voltage generator supplies gamma reference voltages via a gamma voltage line to the flexible circuit board having the data driver thereon.

18. The apparatus of claim 17, wherein the first dedicated VDD signal line provided on the LCD panel is configured to carry signals for the gamma voltage generator.

19. The apparatus of claim 18, wherein the second dedicated VDD signal line provided on the LCD panel is configured to carry signals for the data driver.

20. The apparatus of claim 17, wherein the horizontal crosstalk compensation circuit is positioned on the first dedicated VDD signal line.

21. The apparatus of claim 17, wherein the horizontal crosstalk compensation is configured with at least a first coil component.

22. The apparatus of claim 17, wherein the horizontal crosstalk compensation circuit filters the ripple in a current of the VDD signal while scanning a high gray level area.

* * * * *